US005851751A

United States Patent [19]

Wallis et al.

[11] Patent Number: 5,851,751

[45] **Date of Patent: *Dec. 22, 1998**

[54] PHOTOGRAPHIC MATERIALS WITH IMPROVED IMAGE TONE

[75] Inventors: Julian M. Wallis, Cheshunt; Robert J. D. Nairne, Bishops Stortford, both of Great Britain; Alexis Zinn-Warner, Maplewood, Minn.

[73] Assignee: Imation Corp., Oakdale, Minn.

[ * ] Notice: The term of this patent shall not extend beyond the expiration date of Pat. No. 5,716,773.

[21] Appl. No.: 784,671

[22] Filed: Jan. 21, 1997

[30] Foreign Application Priority Data

Feb. 21, 1996 [GB] United Kingdom ..... 9603658

[51] Int. Cl.[6] ..... G03C 1/035; G03C 1/10; G03C 1/005

[52] U.S. Cl. ..... 430/567; 430/565; 430/600; 430/603; 430/613; 430/605

[58] Field of Search ..... 430/567, 565, 430/600, 603, 613, 605

[56] References Cited

U.S. PATENT DOCUMENTS

| | | | |
|---|---|---|---|
| 2,298,093 | 10/1942 | Dersch et al. | 430/367 |
| 3,598,597 | 8/1971 | Farren et al. | 430/569 |
| 3,804,629 | 4/1974 | Hammerstein et al. | 430/569 |
| 3,935,014 | 1/1976 | Klotzer | 430/567 |
| 3,957,488 | 5/1976 | Klotzer | 430/567 |
| 4,495,277 | 1/1985 | Becker | 430/567 |
| 4,581,327 | 4/1986 | Habu | 430/567 |
| 4,591,549 | 5/1986 | Matsuzaka | 430/569 |
| 4,639,416 | 1/1987 | Yoshida | 430/567 |
| 4,683,189 | 7/1987 | Idota et al. | 430/248 |
| 4,904,580 | 2/1990 | Komatsu | 430/567 |
| 5,059,517 | 10/1991 | Ihama et al. | 430/567 |
| 5,716,773 | 2/1998 | Nairne et al. | 430/565 |

FOREIGN PATENT DOCUMENTS

| | | | |
|---|---|---|---|
| 0 262 930 A2 | 4/1988 | European Pat. Off. | G03C 7/30 |
| 0 264 954 A2 | 4/1988 | European Pat. Off. | G03C 1/02 |
| 0573373 A2 | 8/1993 | European Pat. Off. | G03C 1/35 |
| 555897-A | 8/1993 | European Pat. Off. | G03C 1/035 |
| 63-201646-A | 8/1988 | Japan | G03C 1/02 |
| 4-294346-A | 10/1992 | Japan | G03C 1/76 |
| 1027146 | 4/1966 | United Kingdom . | |
| 2 095 853 | 10/1982 | United Kingdom | G03C 1/02 |

OTHER PUBLICATIONS

Photographic Science and Engineering vol. 4, No. 5, 1960, pp. 257–263.

*Primary Examiner*—Mark F. Huff
*Attorney, Agent, or Firm*—William K. Weimer

[57] ABSTRACT

A silver halide emulsion of average grain size 0.2 $\mu$m or less comprising silver halide grains having a core and an outer shell, the core comprising at least 85 mol % of the total silver halide content of the grain and at least 50 mol % of the silver halide in the core being silver bromide, and the outer shell comprising silver halide of which greater than 50 mol % is silver chloride; the emulsion either containing no rhodium dopant, or containing rhodium dopant such that the concentration of said dopant is at least as great in the core as in the shell.

10 Claims, No Drawings

PHOTOGRAPHIC MATERIALS WITH IMPROVED IMAGE TONE

FIELD OF THE INVENTION

The invention relates to light sensitive black and white silver halide photographic elements with improved image tone.

BACKGROUND TO THE INVENTION

The image tone of a developed silver halide layer describes the perceived colour of the metallic silver formed by the reduction of silver ion nominally in the form of black filamentous silver. The image tone may be described as blue-black, also known as a cold or hard tone, or brown-black, otherwise known as a warm or soft tone. The tone of an image may be measured by reflectance or transmission of light, depending on the particular application. In images for medical applications, the image is most often viewed by light transmitted through the image. The transmitted tone of a medical image is critical, given the large number of images that need to be viewed, and the limited time available for analysis of each image. The image tone needs to be optimised to provide acceptable image quality, with minimal eye strain on the viewer. To this end, a blue-black image tone is highly desirable. At the same time, there should be no increase in the $D_{min}$, or any staining of the image in unexposed areas.

The tone of a silver image is affected by many factors including grain composition, morphology and size, hardness of the gelatin layers, composition of the developer, and processing conditions. As the grain size of an emulsion decreases, so the image tone can become progressively more yellow-brown, as successively more scattering of the blue component of the light occurs. The image tone also becomes more yellow-brown with increasing bromide (or decreasing chloride) content of the silver halide emulsion. High bromide (or even pure bromide) emulsions are preferred for many applications for reasons of sensitivity, covering power and other photographic properties, but the use of fine-grained versions of such emulsions is restricted by the poor image tone that is generally obtained. Although toning agents are known which can improve the image tone provided by a given emulsion, their effect is insufficient in the case of fine-grained high bromide emulsions.

Although the image tone is most critical in medical applications, the increasing use of fine-grained emulsions in graphic arts photographic emulsions will make image tone important there too. Fine-grained emulsions have many advantages over their larger grained analogues, such as faster processing and better covering power, but have a tendency to exhibit poorer image tone. It is important that the imagewise exposed areas of a half-tone or line art image are perceived as blue-black, and hence the present invention will also be of relevance to graphic arts silver halide materials.

At this point it should be emphasised that image tone as described herein is the deviation from a neutral black caused exclusively by the developed silver halide grains. The overall perceived image tone consists of a number of constituents, such as the colour of the base material and tint arising from the gelatin and other emulsion components, as well as from the developed grains. By using the unexposed regions as the reference when the tone is determined, these other contributions can be accounted for and eliminated from the measured image tone.

The image tone of a developed photographic emulsion depends on a number of factors, including the silver halide grain size, the degree of gelatin hardening (see E. Weyde, Photogr. Korres. 98 (1962) 7), the various processing parameters (such as the developer pH and the nature of the developing agent), and the drying method (see T. H. James, et al., Phot. Sci. & Eng. 1 (1958) 104).

Modification of the perceived image tone of a film can be performed in various ways including the use of a highly blue-tinted base, use of a dye-forming developer, or adaption of the morphology of the developed silver.

K. Futaki et al., Phot. Sci. & Eng. 4 (1960) 257 describe the toning of silver chloride emulsions with various toning agents. U.S. Pat. No. 2,298,093 discusses the problems which arise when attempting to tone silver bromide emulsions and discloses the use of molecules containing the unit -C(=0)NHC(=S)Y- as toners of silver bromide emulsions to impart a blue-black image.

Core-shell emulsions, in which the outer layer(s) have a different halide composition from that of the inner layers(s), are known in the art and disclosed for example in EP 0264954, EP 0107302, U.S. Pat. No. 4,495,277 and GB 2095853. Core-shell emulsions have not been disclosed in the context of controlling the image tone of fine grained emulsions.

The use of core-shell emulsions in which the shell has a high chloride content is known in the field of internal latent image-type direct positive emulsions, as disclosed in U.S. Pat. No. 3,935,014; U.S. Pat. No. 3,957,488; U.S. Pat. No. 4,639,416; U.S. Pat. No. 4,904,580 and EP 0262930 generally for the purpose of improving the sensitometry and stability.

JP-A-63-201,646 discloses improved image tone by the use of a core-shell silver bromochloride emulsion (preferably 40–80 mol % AgBr), where there is more silver bromide at the surface than inside. No toning agents are used.

EP-A-555,897 describes improvement in the image tone of X-ray materials suitable for non-destructive material testing by use of a mixture of two emulsions specifically for use in industrial radiography. The main component is a cubic silver iodobromide emulsion of mean grain size less than 0.30 $\mu$m which by itself gives a poor image tone; this emulsion is mixed with up to 20% of a silver (bromo) chloride emulsion, which then gives a bluer tone.

U.S. Pat. No. 4,581,327 discloses the use of dual-structure grains, where the outermost shell contains at least 80 mol % silver chloride and a rhodium atom, these concentrations being larger than the corresponding concentrations in the core. The disclosed benefit is an improvement in storage stability and "high tone" (from the context it appears that here "tone" means contrast)

In JP-A-04-294,346, the use of mercaptooxadiazoles in emulsions of particle size 0.4 $\mu$m or less is described to improve the image tone. In an example, a core-shell cubic silver chlorobromide emulsion of mean grain size 0.35 $\mu$m is combined with a mercaptooxadiazole, which gives a blue-black image tone compared to the yellowish-black tone of the emulsion without the oxadiazole.

BRIEF SUMMARY OF THE INVENTION

In a first aspect of the invention, there is provided a negative-acting silver halide emulsion of average grain size 0.2 $\mu$m or less comprising silver halide grains having a core and an outer shell, said core comprising at least 85 mol % of the total silver halide content of the grain and at least 50 mol % of the silver halide in said core being silver bromide, and said outer shell comprising silver halide of which greater than 50 mol % is silver chloride; said emulsion either containing no rhodium dopant, or containing rhodium dopant such that the concentration of said dopant is at least as great in the core as in the shell.

In a second aspect of the invention, there is provided a negative-acting silver halide emulsion of average grain size 0.2 μm or less comprising silver halide grains having a core and an outer shell, said core comprising at least 85 mol % of the total silver halide content of the grain and at least 50 mol % of the silver halide in said core being silver bromide, and said outer shell comprising silver halide of which greater than 50 mol % is silver chloride; said emulsion additionally comprising a toning agent.

By addition of a shell of high chloride content to a core of high bromide content, the image tone is markedly improved (i.e., rendered more blue-black). Although it is well known that high-chloride emulsions may give rise to a colder tone than their high-bromide counterparts, it is surprising that the presence of a very thin, high-chloride shell should alter so dramatically the toning properties of what is essentially a high-bromide emulsion. Furthermore, the presence of a high-chloride outer layer surprisingly enables the full potential of added toning agents to be exploited, many of such compounds being less effective with conventional high-bromide emulsions than with high-chloride emulsions. The use of toning agents in combination with emulsions of the invention enables images of excellent blue-black tone to be obtained, while retaining the beneficial sensitometric properties of conventional high-bromide emulsions. This allows flexibility in the choice of the support to be used (clear or blue-tinted), and avoids need for toner dyes formed during development which often have a low stability.

Although there exists an extensive literature relating to core-shell grains in general, the emulsions claimed herein are believed to be novel. U.S. Pat. No. 4,581,327 discloses fine-grained core-shell emulsions in which the shell comprises at least 80 mol % silver chloride, and the silver chloride content of the core is less than that of the shell. The emulsions further comprise a rhodium dopant whose concentration is greater in the shell than in the core, the stated advantage being increased contrast and improved resistance to storage fog. Although the full range of core/shell volume ratios is claimed (from 100:1 to 1:100, preferably 10:1 to 1:10), no advantage is taught for ultra-thin shells, and indeed none of the examples has a core/shell volume ratio greater than 2:1. The emulsions of the present invention have a core/shell volume ratio of at least 5:1.

DESCRIPTION OF PREFERRED EMBODIMENTS

Silver halide grains encompassed by the scope of this invention are those with a mean grain size of less than 0.20 μm. The present invention seeks to improve the tone of small grained, high bromide content emulsions without unduly affecting the speed of the emulsion, the covering power of the emulsion and the ability to use existing processing systems. The speed of the emulsion will be affected by the chloride content. Additionally, processing systems designed to cope with pure bromide emulsions can still be used if only a limited quantity of chloride is introduced into the system. The small size of grains must be maintained when a shell is provided to maintain the covering power of an emulsion. Thus, the shell must be thin to avoid greatly increasing the size of the grains or the chloride content.

Preferably, the core comprises at least 90%, and more preferably at least 95% of the total silver halide content of the grain.

The silver halide core can consist of silver bromide, silver iodobromide, silver chlorobromide or silver iodochlorobromide, provided that the silver bromide content of the core is at least 50 mol %, preferably at least 80 mol % and most preferably at least 90%. It is envisaged that the silver halide core can, if desired, consist of any number of layers, which individually can have any ratio of silver chloride, bromide and iodide, provided that the overall core composition is consistent with the preceding description.

The silver halide shell is the outermost layer of the grain and can consist of silver chloride, silver bromochloride, silver iodochloride or silver iodobromochloride, provided that the silver chloride content of the shell is greater than 50 mol %, preferably at least 80 mol %, and most preferably at least 90 mol %.

The morphology of the silver halide grains is typically but not limited to, the cubic or octahedral habits. Also included in the scope of the invention are tetrahedral, rhombododecahedral and icosatetrahedral grains, as well as mixtures of these shapes.

Rounded grains, laminar or tabular grains and grains of less well defined shape are also envisaged.

The emulsion can be prepared, washed, and both chemically and spectrally sensitised by the techniques well known to those skilled in the art. In particular, during the emulsion preparation, additives such as metal ions can be used to improve reciprocity behaviour, or to further enhance contrast, such as the ions of rhodium, ruthenium or iridium. It is envisaged that the additives may also be present in either or both the core and the shell. Similarly, the additives may display a concentration variation of any desired complexity along the radius of the grains, which includes location in the core or in the shell, except when a rhodium dopant is present, in which case the concentration of dopant in the shell is no greater than the concentration in the core. The emulsion is spectrally sensitised using a dye which will enhance the sensitivity of the silver halide grains to the wavelength of the exposing device. For example, where a helium-neon laser is the output device, the emulsion can be spectrally sensitised to 633 nm; where an infrared laser diode is the output device the emulsion can be sensitised, for example, in the region 780–830 nm. The emulsion can be suitable for continuous tone or half-tone image reproduction.

The photographic silver halide emulsions can contain other addenda conventional in the photographic art, such as binders like gelatin; main group metal ions; transition metal ions; chemical sensitisers such as compounds of sulphur, selenium, tellurium, gold, palladium and platinum; a spectral sensitising dye or mixture of one or more spectral sensitising dyes covering the range 400 nm –1000 nm; supersensitisers; development modifiers such as polyethyleneglycols; antifoggants; stabilisers; developing agents and auxiliary developing agents; cross-linking agents; colloids; latices and surfactants to improve physical properties; antistatic compounds; coating aids such as anionic, cationic or non-ionic surfactants and lubricants; matting agents; filter dyes, etc. Such materials are further described in, for example, Research Disclosure, December 1978, item 17643. Common additives and methods of preparation are likewise described in Research Disclosure, Produce Licensing Index, December 1971, item 9232, and are encompassed in the scope of this invention by reference. Compounds which modify the contrast of the emulsion (by increasing it or decreasing it), such as hydrazine derivatives or hydroxamic acid derivatives are specifically envisaged.

Preferred emulsions in accordance with the invention additionally comprise one or more toning agents which can improve the image tone by rendering it more blue-black in colour. Any of the compounds disclosed in the art as having this property may be used, including the compounds disclosed in Phot. Sci & Eng. 4 (1960), p. 257; U.S. Pat. No. 2,298,093; and Japanese Patent Publication No. 04-294346. However, the preferred toners for use with the present invention are those which have a nucleus of formula I or II:

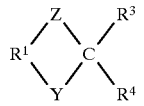

I

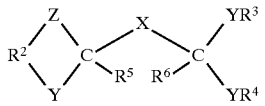

II wherein:

$R^1$ and $R^2$ independently represent the atoms selected from C, N, O and S necessary to complete a 5, 6 or 7 membered ring;

$R^3$ and $R^4$ independently represent H, alkyl or aryl groups or together represent the atoms selected from C, N, O and S necessary to complete a 5, 6 or 7 membered ring (but are not both H);

$R^5$ and $R^6$ independently represent H, alkyl or aryl groups or together represent the atoms selected from C, N, O and S necessary to complete a 5, 6 or 7 membered ring; and X represents a bond or a divalent linking group, preferably an alkylene group (e.g., methylene or ethylene group) and more preferably —$CH_2$—OR —$C_2H_4$—;

each Y may be the same or different and is selected from O, $NR^7$ (where $R^7$ is H or alkyl of up to 5 carbon atoms), S, or Se;

and Z is S or Se.

Examples of such toners are disclosed in EP-A-0750223. Toning compounds may be added at any time during the preparation of the photographic emulsion, such as before grain precipitation, during or after the growth of the grains, or before or after chemical or spectral sensitisation. Typically the compounds are added just before the coating of the emulsion layers. One or more toning agents may be added to the emulsion to provide the best improvement in image tone.

Preferably the toning agents are incorporated into the emulsion at levels of between 0.001 and 10 g/mol Ag; especially preferred, between 0.01 and 2 g/mol Ag. Any suitable solvent may be used to dissolve the compound, e.g., water, methanol, ethanol, acetone or DMF. Alternatively, the toning agent may be added as a solid, a dispersion in an oil or other water-immiscible liquid, a dispersion in a gelatin matrix, or by any of the other usual techniques familiar to one skilled in the art. The toning agents added should not have significant impact on sensitometric properties of the film, e.g., photographic speed, contrast, $D_{min}$ and $D_{max}$.

The image tone of the exposed film can be measured using any suitable technique. Measurement of the image tone may be done by way of CIE colour co-ordinates at optical densities of around 1. The parameter associated with the blueness is the b* coordinate, with the more positive the number the more yellow the image tone and, therefore, the more negative the value for b* the more blue the colour.

Changes in b* of ±1 unit are readily detectable by the human eye, and so a decrease of one or more units in the value of b* may be taken as a significant improvement in image tone. For values of L* (lightness) of about 40–60 (the mid-tone region), values of b* of about zero represent a commercially acceptable neutral tone.

In the following Examples, the quoted b* values are corrected values, with contributions from the substrate, residual dye stain etc. subtracted out. Since a given emulsion can show different toning behaviour when processed in different developer compositions, results were generated using two commercially available developers, namely "XAD3" developer (Minnesota Mining and Manufacturing Company) and "RP X-Omat" developer (Kodak) to verify the generality of the trends.

The invention is hereinafter described in more detail by way of example only.

Preparation of Emulsion A (Comparison)

This is a pure silver bromide emulsion, of mean grain size 0.11 μm. A kettle solution consisting of 7.7% gelatin, pH=3.0 and pBr=3.05 at 40° C. was prepared. Solutions of silver nitrate (3.84M) and potassium bromide (3.98M) were used to nucleate a seed population (10 ml of each solution over 7 seconds), and after 3 minutes the silver and bromide solutions were added under pAg controlled conditions at a linearly increasing rate, such that 4.232 mol silver nitrate was added over 38 minutes. The total silver precipitated was thus 4.27 mol. The resulting grains were rounded cubes of mean equivalent circle diameter 0.110 μm with a coefficient of variation of 12%.

Preparation of Emulsion B (Invention)

This emulsion consists of a pure silver bromide core containing 95.2 mol % of the total silver halide, and a pure silver chloride shell containing 4.8 mol % of the silver. A pure silver bromide core was prepared in an identical way to Emulsion A, except that the addition rates were increased by 7%. Thus the core emulsion consisted of 4.570 mol silver. To this was added more silver nitrate solution (3.84M) and potassium chloride solution (3.98M) at a constant rate of 0.0411 mol/minute, until a further 0.230 mol silver had been added. Thus the final emulsion contained 4.80 mol silver, and the shell contained 4.8% of the precipitated silver. The emulsion habit was rounded cubic, with mean equivalent circle diameter of 0.143 μm and coefficient of variation of 12%.

Preparation of Emulsion C (Invention)

This emulsion consists of a pure silver bromide core containing 90.1 mol % of the total silver halide, and a pure silver chloride shell containing 9.9 mol % of the total silver halide. A pure silver bromide core was prepared using an identical kettle solution to Emulsion A. The seed grains were nucleated using 10.6 ml of silver nitrate solution (3.84M) and 10.6 ml potassium bromide solution (3.98M), and then the same solutions were added at a linearly increasing rate such that 4.112 mol silver was added over 35.83 minutes, under controlled pAg conditions. Subsequently silver nitrate solution (3.84M) and potassium chloride solution (3.98M) were double-jetted at a constant rate such that 0.452 mol silver chloride was precipitated in 11.1 minutes. The total silver halide precipitated was thus 4.564 mol, and the shell contained 9.9% of the total silver halide. The emulsion habit was slightly-rounded cubic, with mean equivalent circle diameter of 0.141 μm.

Preparation of Emulsion E (Invention)

This emulsion consists of a pure silver bromide core containing 95.4 mol % of the total silver halide, and a pure silver chloride shell containing 4.6 mol % of the total silver halide. A pure silver bromide core was prepared in an identical way to emulsion A. The core consisted of 4.42 mol silver halide. 10 minutes after the precipitation more silver nitrate (3.84M) and potassium chloride solution (3.98M) were added at a constant rate of 0.0411 mol/min, until a further 0.212 mol silver halide had been precipitated. The total silver halide precipitated was thus 4.63 mol, and the emulsion habit was rounded cubic, with mean equivalent circle diameter of approximately 0.14 μm.

Preparation of Emulsion F (Invention)

This emulsion consists of a silver iodobromide core containing 95.3 mol % of the total silver halide, and a pure silver chloride shell containing 4.7 mol % of the total silver halide. The halide composition of the core is 99 mol % bromide and 1 mol % iodide. A kettle solution consisting of 7.7 wt % inert gelatin at pH 3.0, pBr 2.0 and temperature 40° C. was prepared. Solutions of silver nitrate (3.84M) and potassium iodobromide (4.00M KBr and 0.04M KI) were used to nucleate a seed population (10 ml of each solution over 7 seconds) and after 3 minutes the same silver and halide solutions were added at a linearly increasing rate such that 4.34 mol silver was added over 38 minutes, giving a silver iodobromide core emulsion containing 4.39 mol silver. After 10 minutes more silver nitrate solution (3.84M) and potassium chloride solution (3.32M) was added to this core at a constant rate of 0.411 mol/min and 0.0493 mol/min respectively, until a further 0.215 mol silver halide had been precipitated. The total silver halide precipitated was thus 4.61 mol, and the emulsion habit was polyhedral, with mean equivalent circle diameter of 0.16 μm.

Preparation of Emulsion G (Invention)

This emulsion consists of a silver iodobromide core containing 95.8 mol % of the total silver halide, and a pure silver chloride shell containing 4.2 mol % of the total silver halide. The halide composition of the core is 99 mol % bromide and 1 mol % iodide. A silver iodobromide core emulsion was prepared as described for Emulsion F, with a total of 4.47 mol silver halide being precipitated. The resulting core grains were octahedral of equivalent circle diameter 0.16 μm. The temperature of the kettle was subsequently raised to 55° C., and the emulsion was chemically sensitised and stabilised as described below. A silver chloride shell was deposited on the chemically sensitised core grains in an identical way to Emulsion F, such that a further 0.192 mol silver halide was precipitated. Thus the final emulsion contained 4.66 mol silver with a silver chloride shell containing 4.1% of the total silver precipitated. The emulsion was polyhedral, with a mean diameter of 0.17 μm.

Emulsions A–G were similarly chemically sensitised using N-methylthiosuccinimide and sodium tetrachloroaurate and the total gelatin content was adjusted to 120.0 g/mol. Each emulsion was spectrally sensitised to the infrared part of the spectrum using a mixture of two heptamethine cyanine dyes. For Examples 3 to 6, toning agents were added to the emulsions as ca. 1% solutions in dimethylformamide just before coating. The emulsions were coated at a nominal coating weight of 1.7 g/m$^2$ , and subjected to a heat treatment (16 hr, 38° C.) before evaluation.

Toning agents incorporated into the emulsions include examples used for high silver chloride content emulsions (toners 1–6, EP-A-0750223); toner 7, see Ohyama and Futaki, Phot. Sci. & Eng. 7 (1963) 84):

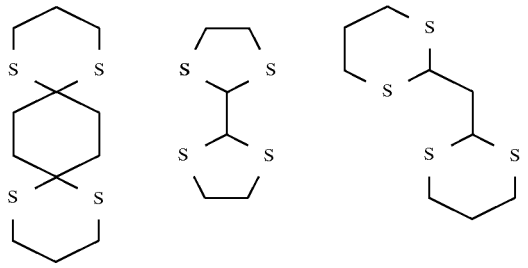

TONER 1

TONER 5

TONER 3

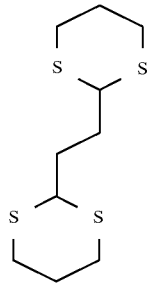

TONER 4

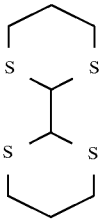

TONER 2

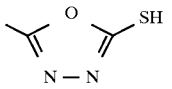

TONER 7

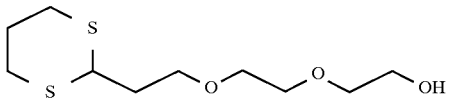

TONER 6

For sensitometric evaluation, strips of film were exposed by a white light source via a 0.0–4.0 density continuous tone wedge and an 800 nm broad band filter. For tone measurement, strips of film were similarly exposed through a 0.0–3.0 density step wedge, and the tone of the base material was subtracted from each strip to give the true tone of the developed emulsion. All samples were developed in either (a) 3M XAD3 developer at 34° C. for 25 seconds in an Autopan Contimat 230 processor, or (b) Kodak RP X-OMat developer at 34° C. for 25 seconds in the Autopan 230 processor. SP-1 is measured at 0.1 above fog and A-Con is measured as the gradient between optical densities 0.13+ fog and 1.0+fog.

EXAMPLE 1

This example shows that the addition of a silver chloride shell (containing 4.8 mol % or 9.9 mol % of the total silver) to a fine-grained silver bromide core emulsion gives an improvement in image tone. Samples of coatings of IR sensitised emulsions A, B and C were exposed and processed as described above, using a step wedge. The L*a*b* co-ordinates were then measured, allowing the image tone (b*) to be determined as a function of density (i.e., at different L* values) for each emulsion. In all three cases, no toning agents were present.

Surprisingly, addition of only 4.8 mol % silver chloride to the bromide emulsion as a shell gives significant improvement in the image tone. This is particularly noticeable at L* in the range 40–60 (corresponding to densities of approximately 0.8–1.2) where the 4.8% chloride-shell AgBr emulsion b* is reduced by almost four units in XAD3 chemistry. Kodak RP X-Omat chemistry shows a smaller overall range of tone values, but here too the chloride-shell emulsion displays an improved image tone.

| Emulsion | AgCl Shell* | Developer | Lightness L* | Image tone b* |
|---|---|---|---|---|
| A | 0.0 | Kodak RPX | 0.6 | 0.7 |
| (Comparison) | | | 6.4 | 4.8 |
| | | | 51.6 | 5.3 |
| | | | 91.8 | 1.3 |
| B | 4.8 | Kodak RPX | 0.2 | −0.2 |
| (Example) | | | 20.1 | 4.2 |
| | | | 64.9 | 2.7 |
| | | | 94.8 | 0.3 |
| C | 9.9 | Kodak RPX | 4.3 | 3.7 |
| (Example) | | | 17.6 | 4.3 |
| | | | 33.4 | 4.1 |
| | | | 63.1 | 2.3 |
| A | 0.0 | 3M XAD3 | 1.8 | 4.2 |
| (Comparison) | | | 40.9 | 8.4 |
| | | | 88.7 | 3.3 |
| B | 4.8 | 3M XAD3 | 0.2 | −1.8 |
| (Example) | | | 3.2 | 3.4 |
| | | | 49.8 | 4.8 |
| | | | 90.4 | 1.4 |
| C | 9.9 | 3M XAD3 | 6.6 | −1.9 |
| (Example) | | | 16.6 | 2.4 |
| | | | 44.1 | 3.1 |
| | | | 84.0 | 0.2 |

*mol % of total silver halide

EXAMPLE 2

This example shows that the addition of a silver chloride shell (containing less than 5 mol % of the total silver) to a fine grained octahedral or cubic silver bromide or silver iodobromide core emulsion gives an improved image tone. Samples of coatings of IR sensitised emulsions A, E, F, and G were exposed and processed as described above using a continuous tone wedge. The L*a*b* co-ordinates were then measured at a density close to 1.0.

| Emulsion | AgCl shell* | Developer | Lightness L* | Image tone b* |
|---|---|---|---|---|
| A (Comparison) | 0.0 | Kodak RPX | 34.4 | 5.4 |
| E (Example) | 4.6 | Kodak RPX | 39.4 | 2.3 |
| F (Example) | 4.7 | Kodak RPX | 39.4 | 0.7 |
| G (Example) | 4.2 | Kodak RPX | 38.1 | 0.1 |

*mol % of total silver halide

EXAMPLE 3

This Example shows that the addition of toning agents to emulsions of the invention gives a further improvement in image tone; similarly it demonstrates that addition of the same toning agents to a pure silver bromide emulsion has insufficient effect on the image tone.

| Emulsion | Toning Agent | Amount mg/mol | Developer | Lightness L* | Image tone b* |
|---|---|---|---|---|---|
| A | None | 0 | 3M XAD3 | 40.9 | 8.4 |
| (Comparison) | 1 | 200 | | 46.9 | 7.9 |
| | 2 | 200 | | 39.8 | 7.0 |
| | 2 | 500 | | 46.3 | 5.0 |

-continued

| Emulsion | Toning Agent | Amount mg/mol | Developer | Lightness L* | Image tone b* |
|---|---|---|---|---|---|
| B | None | 0 | 3M XAD3 | 49.8 | 4.8 |
| (Example) | 1 | 200 | | 57.5 | 3.9 |
| | 1 | 500 | | 47.6 | 3.6 |
| | 2 | 200 | | 47.1 | 2.4 |
| | 2 | 500 | | 48.2 | 1.8 |
| | 7 | 500 | | 51.9 | 0.2 |
| C(Example) | None | 0 | 3M XAD3 | 39.1 | 4.7 |
| | 2 | 500 | | 48.6 | 1.1 |
| A | None | 0 | Kodak RPX | 51.6 | 5.3 |
| (Comparison) | 1 | 200 | | 56.9 | 6.1 |
| | 2 | 200 | | 55.0 | 6.2 |
| B(Example) | None | 0 | Kodak RPX | 64.9 | 2.7 |
| | 1 | 200 | | 39.0 | 3.1 |
| | 2 | 200 | | 63.7 | 1.9 |
| | 2 | 500 | | 52.7 | −0.4 |
| C | None | 0 | Kodak RPX | 63.1 | 2.3 |
| (Example) | 1 | 1000 | | 50.6 | 1.8 |
| | 2 | 500 | | 63.7 | −1.5 |

A number of conclusions can be drawn from this table. Firstly, the addition of toning agents to comparison Emulsion A (AgBr), even at the highest levels does not reduce b* to the value achieved by Emulsion B in the absence of any toning agent; furthermore it should be made clear that at still higher levels the emulsion is desensitised by the added toning agent. Thus, it is clear that an acceptable image tone cannot be obtained by using a combination of this class of toning agent and a fine-grained pure silver bromide emulsion. Secondly, toning of Emulsion B (with a pure silver chloride shell corresponding to 4.8 mol % of the total silver) is demonstrated, with the tone value dropping from 4.8 in the absence of toning agent to 1.8 at the most favorable level of Toner 2 (XAD3 developer). An improvement of similar magnitude is displayed by Emulsion C which has a pure silver chloride shell corresponding to 9.9 mol % of the total silver. Furthermore, in Kodak RPX developer, highly-desirable negative b* values are obtained from both emulsions of the invention in the presence of toning agents.

EXAMPLE 4

This Example shows that the addition of toning agents to chloride shelled octahedral and cubic emulsions gives a dramatic improvement in image tone.

| Emulsion | Toning Agent | Amount mg/mol | Developer | Lightness L* | Image tone b* |
|---|---|---|---|---|---|
| A (Comparison) | None | 0 | Kodak RPX | 34.4 | 5.4 |
| E | None | 0 | Kodak RPX | 39.4 | 2.3 |
| (Example) | 1 | 500 | | 34.6 | 0.9 |
| | 2 | 500 | | 38.7 | −1.5 |
| | 3 | 500 | | 40.3 | 0.0 |
| | 4 | 500 | | 37.2 | 1.3 |
| | 5 | 500 | | 34.6 | −2.6 |
| F(Example) | None | 0 | Kodak RPX | 39.4 | 0.7 |
| | 1 | 400 | | 38.1 | 0.0 |
| | 2 | 400 | | 39.4 | −2.8 |
| | 3 | 400 | | 36.6 | −0.5 |
| | 4 | 400 | | 36.9 | 0.2 |
| | 5 | 400 | | 37.0 | −0.3 |

-continued

| Emulsion | Toning Agent | Amount mg/mol | Developer | Lightness L* | Image tone b* |
|---|---|---|---|---|---|
| G | None | 0 | Kodak RPX | 39.4 | 0.7 |
| (Example) | 1 | 400 | | 36.4 | −0.4 |
| | 2 | 400 | | 39.8 | −3.2 |
| | 3 | 400 | | 39.2 | −2.3 |
| | 4 | 400 | | 39.4 | −2.0 |
| | 5 | 400 | | 36.5 | −1.8 |

EXAMPLE 5

That Example shows that there is no detrimental effect on the sensitometric response of the chloride-shelled emulsions at the levels of toner added here.

| Emulsion | Toning Agent | Amount mg/mol | Developer | SP-1 | A-Con |
|---|---|---|---|---|---|
| A(Comparison) | None | 0 | 3M XAD3 | 1.66 | 1.73 |
| B(Example) | None | 0 | 3M XAD3 | 2.02 | 1.73 |
| | 1 | 200 | | 1.98 | 1.62 |
| | 1 | 500 | | 1.76 | 1.47 |
| | 2 | 200 | | 2.02 | 1.76 |
| | 2 | 500 | | 1.74 | 1.64 |
| C(Example) | None | 0 | 3M XAD3 | 2.02 | 1.36 |
| | 2 | 500 | | 1.96 | 1.34 |
| A(Comparison) | None | 0 | Kodak RPX | 1.58 | 1.63 |
| B(Example) | None | 0 | Kodak RPX | 1.96 | 1.60 |
| | 1 | 200 | | 1.84 | 1.52 |
| | 1 | 500 | | 1.59 | 1.34 |
| | 2 | 200 | | 1.88 | 1.56 |
| | 2 | 500 | | 1.68 | 1.49 |
| C(Example) | None | 0 | Kodak RPX | 1.91 | 1.18 |
| | 1 | 1000 | | 1.76 | 1.05 |
| | 2 | 500 | | 1.88 | 1.26 |

From the data in the Table it is clear that there is an intrinsic speed advantage of the chloride-shelled emulsions. At higher levels of toner there is a loss in speed of the chloride-shelled emulsions, but the resulting speed is still greater than the comparison emulsion.

EXAMPLE 6

Emulsion B was tested with Toner (6) as described in previous Examples, except that exposures were performed via a laser scanner rather than a filtered white light source, and so the sensitometric data cannot be compared directly with the data from Example 5. The following results were obtained when processed in Kodak RPX-Omat developer:

| Toner Concn. (mg/mol Ag) | L* | b* | Sp-1 | A-Con |
|---|---|---|---|---|
| none | 47.71 | 5.81 | 1.48 | 1,84 |
| 100 | 50.50 | 5.24 | 1.37 | 1.57 |
| 500 | 47.62 | 2.61 | 1.37 | 1.37 |
| 1000 | 56.02 | 1.16 | 1.42 | 1.26 |

Thus Toner (6) was also found to be effective in providing a blue-black tone with emulsions in accordance with the invention, without significant effect on the imaging speed. Although a significant reduction in contrast was observed, this is actually beneficial for the emulsion in question, which is intended for use in medical imaging via laser scanners.

We claim:

1. A silver halide emulsion of average grain size 0.2 $\mu$m or less comprising:

(a) silver halide grains having a core and an outer shell, wherein the core comprises at least 85 mole % of the total silver halide content of the grain, at least 50 mole % of the silver halide in the core is silver bromide, and the outer shell comprises silver halide of which greater than 50 mol % is silver chloride; and (b) a toning agent comprising a compound of formula I or II:

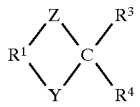

I

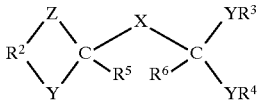

II wherein:

$R^1$ and $R^2$ independently represent the atoms selected from C, N, O and S necessary to complete a 5, 6, or 7 membered ring;

$R^3$ and $R^4$ independently represent H, alkyl or aryl groups, or together represent the atoms selected from C, N, O and S necessary to complete a 5, 6 or 7 membered cyclic ring but are not both H;

$R^5$ and $R^6$ independently represent H or alkyl groups, or together represent the atoms selected from C, N, O and S necessary to complete a 5, 6 or 7 membered ring;

X represents a bond or a divalent linking group;

each Y may be the same or different and is selected from the group consisting of O, $NR^7$, S, and Se, where $R^7$ is H or alkyl of up to 5 carbon atoms; and Z is S or Se.

2. A silver halide emulsion according to claim 1 wherein the core comprises at least 80 mol % silver bromide.

3. A silver halide emulsion according to claim 1 wherein the silver halide core is a member selected from the group consisting of silver bromide, silver iodobromide, silver chlorobromide and silver iodochlorobromide and the silver halide shell is a member selected from the group consisting of silver chloride, silver bromochloride, silver idochloride and silver iodobromochloride.

4. A silver halide emulsion according to claim 1 wherein the outer shell comprises at least 80 mol % silver chloride.

5. A silver halide emulsion according to claim 1 wherein the core comprises at least 90 mol % of the total silver halide content of the grain.

6. A silver halide emulsion according to claim 1 wherein the toning agent is present in an amount of between 0.001 and 10 g/mol Ag.

7. A silver halide emulsion according claim 1 wherein said toning agent is a member selected from the group consisting of:

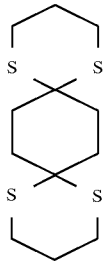

TONER 1

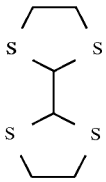

TONER 5

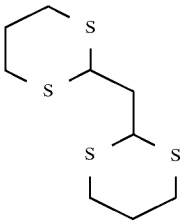

TONER 3

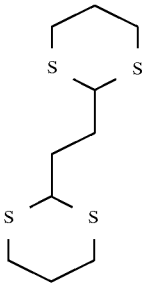

TONER 4

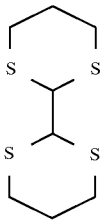

TONER 2

-continued

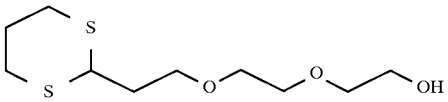

TONER 6

8. A silver halide emulsion according to claim 1 further comprising at least one of:

a contrast enhancing additive selected from the ions of rhodium, ruthenium or iridium, and a dye to spectrally sensitise said emulsion.

9. A silver halide emulsion according to claim 1 coated on a substrate to form a photosensitive imaging element.

10. A photosensitive imaging element according to claim 9 wherein said substrate is transparent, said emulsion is coated on one side of said substrate and a protective top coat overlies said emulsion layer and wherein an antihalation layer is coated on the other side of said substrate to said emulsion layer.

* * * * *